US010048710B2

(12) United States Patent
Jefremow et al.

(10) Patent No.: US 10,048,710 B2
(45) Date of Patent: Aug. 14, 2018

(54) BYPASS MODE FOR VOLTAGE REGULATORS

(71) Applicant: Dialog Semiconductor (UK) Limited, London (GB)

(72) Inventors: Mihail Jefremow, Bayern (DE); Dan Ciomaga, Bayern (DE); Marcus Weis, Munich (DE); Stephan Drebinger, Munich (DE); Fabio Rigoni, Karlsfeld (DE)

(73) Assignee: Dialog Semiconductor (UK) Limited, London (GB)

( * ) Notice: Subject to any disclaimer, the term of this patent is extended or adjusted under 35 U.S.C. 154(b) by 0 days.

(21) Appl. No.: 15/162,184

(22) Filed: May 23, 2016

(65) Prior Publication Data

US 2017/0205841 A1 Jul. 20, 2017

(30) Foreign Application Priority Data

Jan. 14, 2016 (DE) ..... 10 2016 200 390

(51) Int. Cl.
*G05F 1/565* (2006.01)
*G05F 1/575* (2006.01)

(52) U.S. Cl.
CPC ..... *G05F 1/575* (2013.01)

(58) Field of Classification Search
CPC . G05F 1/575; G05F 1/56; G05F 1/563; G05F 1/565
USPC ..... 323/226, 273, 274, 275, 276, 277, 278, 323/279, 280, 281, 303
See application file for complete search history.

(56) References Cited

U.S. PATENT DOCUMENTS

| | | | | |
|---|---|---|---|---|
| 2006/0164053 | A1 | 7/2006 | Walter et al. | |
| 2012/0126760 | A1 | 5/2012 | Vemula | |
| 2012/0280667 | A1* | 11/2012 | Drebinger | G05F 1/575 323/273 |
| 2013/0147447 | A1* | 6/2013 | Liu | G05F 1/575 323/273 |
| 2015/0061622 | A1* | 3/2015 | Bhattad | G05F 1/56 323/280 |

(Continued)

OTHER PUBLICATIONS

German Office Action, File No. 10 2016 200 390.9, Applicant: Dialog Semiconductor (UK) Limited, dated May 11, 2016, 7 pgs and English language translation, 9 pgs.

*Primary Examiner* — Alex Torres-Rivera
(74) *Attorney, Agent, or Firm* — Saile Ackerman LLC; Stephen B. Ackerman

(57) ABSTRACT

A voltage regulator which provides at an output node a load current at an output voltage is described. The voltage regulator comprises a pass transistor for providing the load current at the output node from an input node, and a driver stage configured to set the gate voltage of the pass transistor based on a drive current. The voltage regulator has voltage regulation means to set the drive current in dependence of an indication of the output voltage at the output node and in dependence of a reference voltage for the output voltage. The voltage regulator has bypass regulation means to set the drive current in dependence of an indication of the gate-to-source voltage at the pass transistor and in dependence of a target voltage for the gate—to activate the voltage regulation means and/or the bypass regulation means. source voltage. The voltage regulator also comprises mode selection means.

27 Claims, 8 Drawing Sheets

(56) References Cited

U.S. PATENT DOCUMENTS

| | | | | |
|---|---|---|---|---|
| 2015/0077076 | A1 | 3/2015 | Bhattad | |
| 2015/0130434 | A1* | 5/2015 | Jain | G05F 1/575 323/280 |
| 2016/0072516 | A1* | 3/2016 | Shill | H03M 1/06 323/313 |

* cited by examiner

BYPASS MODE FOR VOLTAGE REGULATORS

TECHNICAL FIELD

The present document relates to a voltage regulator. In particular, the present document relates to a voltage regulator providing a bypass mode with low resistance.

BACKGROUND

Voltage regulators are frequently used for providing a load current at a stable load voltage to different types of loads (e.g. to the processors of an electronic device). A voltage regulator derives the load current from an input node of the regulator, while regulating the output voltage at the output node of the regulator in accordance to a reference voltage.

SUMMARY

In certain situations, it may be desirable to bypass the regulation and to provide the load current directly from the input node in a power efficient manner. The present document addresses the technical problem of providing a voltage regulator having a stable and power-efficient bypass mode for different load conditions. According to an aspect, a regulator (notably a voltage regulator such as a linear dropout regulator) is described. The regulator is configured to provide at an output node of the regulator a load current at an output voltage. The output node of the regulator may be coupled to a load (e.g. to a processor) which is to be operated using the load current.

The regulator (notably the voltage regulator) comprises a pass transistor (e.g. an n-type metal oxide semiconductor transistor) for providing the load current at the output node from an input node. The input node may correspond to a drain of the pass transistor and the output node may correspond to a source of the pass transistor. Furthermore, the regulator comprises a driver stage which is configured to set a gate voltage at a gate of the pass transistor based on a drive current. The driver stage may comprise a drive transistor (e.g. an NMOS transistor) having a gate that is coupled to the gate of the pass transistor, having a source that is coupled to a source of the pass transistor, and having a drain that is coupled to the gate of the drive transistor. The drive current may correspond to the current through the drive transistor.

The regulator further comprises voltage regulation means which are configured to set the drive current in dependence of an indication of the output voltage at the output node and in dependence of a reference voltage for the output voltage. The voltage regulation means may comprise feedback means (e.g. a voltage divider) for deriving a feedback voltage from the output voltage at the output node (the feedback voltage being the indication of the output voltage). Furthermore, the voltage regulator means may comprise a differential amplifier which is configured to control a current through a feedback control transistor in dependence of the feedback voltage and in dependence of the reference voltage, notably in dependence of a difference between the feedback voltage and the reference voltage. The drive current may then depend on the current through the feedback control transistor. As such, the voltage regulator means may be used to regulate the output voltage at the output node of the regulator in accordance to the reference voltage.

Furthermore, the regulator comprises bypass regulation means which are configured to set the drive current in dependence of an indication of the gate-to-source voltage at the pass transistor and in dependence of a target voltage for the gate-to-source voltage. In particular, the bypass regulation means may be configured to set the drive current such that the gate-to-source voltage at the pass transistor is set in accordance to (e.g. is equal to) the target voltage for the gate-to-source voltage. By doing this, a power-efficient and stable bypass mode may be provided for providing the load current directly from the input node, without regulating the output voltage. By setting the gate-to-source voltage to a target voltage (i.e. to a target gate-to-source voltage), regardless the level of the output voltage, the drop-out voltage at the pass transistor may be kept small for varying load conditions.

In addition, the regulator may comprise mode selection means which are configured to activate the voltage regulation means and/or the bypass regulation means (e.g. in a mutually exclusive manner). As such, the regulator may be operated in a voltage regulation mode and in a bypass mode in a selective manner.

The bypass regulation means may comprise sensing means which are configured to provide a sense current as the indication of the gate-to-source voltage at the pass transistor. Furthermore, the bypass regulation means may comprise monitoring means which are configured to provide a monitor current which is dependent on the target gate-to-source voltage. The monitoring means may be configured to provide the monitor current also in dependence of a process parameter and/or in dependence of an operation temperature of the driver stage. By doing this, PVT (process, voltage, temperature) conditions are compensated to provide a fixed gate-to-source voltage to the pass transistor.

In particular, the monitoring means may comprise a monitor transistor which is a scaled copy of the drive transistor. A gate-to-source voltage at the monitor transistor may correspond to the target voltage. As such, the monitor current may be indicative of the target voltage at the actual PVT conditions. In particular, the monitor current may be proportional to (or equal to) a target current which is the drive current through the drive transistor that is required to set the gate-to-source voltage at the pass transistor to the target voltage. Typically there is a direct relationship (e.g. a near-quadratic relationship) between the gate-to-source voltage at the pass transistor and the drive current through the drive transistor, wherein the relationship typically depends on the actual PVT conditions of the drive and pass transistor.

The bypass regulation means may comprise a current comparator which is configured to determine a bypass control signal by comparing the sense current and the monitor current. The current comparator may be configured to increase or decrease the bypass control signal, depending on whether the sense current is greater or smaller than the monitor current.

Furthermore, the bypass regulation means may comprise bypass driver means which are configured to set the drive current in dependence of the bypass control signal. In particular, the bypass driver means may comprise a bypass control transistor which is controlled by the bypass control signal, wherein the drive current may depend on the current through the bypass control transistor. In particular, the drive current may be derived from the current through the bypass control transistor (e.g. using a current mirror), such that the current through the bypass control transistor is proportional to or is equal to the drive current through the drive transistor. The bypass driver signal may be applied to a gate of the bypass control transistor. As such, a current through the bypass control transistor may be controlled by the bypass control signal.

The driver stage may comprise an input transistor which is coupled in series with the bypass control transistor, such that a current through the bypass control transistor corresponds to a current through the input transistor. Furthermore, the driver stage may comprise a first mirror transistor forming a current mirror with the input transistor and providing the drive current, i.e. the current through the first mirror transistor may correspond to the drive current. For this purpose, the first mirror transistor may be arranged in series with the drive transistor.

Furthermore, the feedback control transistor of the voltage regulation means may be arranged in series with the input transistor and the bypass control transistor, such that the currents through the bypass control transistor, the feedback control transistor and the input transistor are equal.

The mode selection means may be configured to deactivate the voltage regulation means by decoupling a gate of the feedback control transistor from an output of the differential amplifier. Furthermore, the mode selection means may be configured to activate the bypass regulation means by coupling the gate of the feedback control transistor to a supply voltage (which is preferably higher than the input voltage at the input node of the regulator). As such, the selection between the voltage regulator mode and the bypass mode may be implemented in an efficient manner.

The sensing means may comprise a second mirror transistor forming a current mirror with the input transistor and providing the sense current. As will be outlined in further detail below, the drive current may provide a precise indication of the gate-to-source voltage at the pass device (due to the above mentioned relationship). By consequence, the current through the second mirror transistor (which is a scaled version of the drive current) provides a precise indication of the gate-to-source voltage at the pass transistor.

The sensing means may comprise a replica transistor having a gate that is coupled to the gate of the pass transistor and having a source that is coupled to a source of the pass transistor. The replica transistor may be a scaled version of the pass transistor. The sense current may be dependent on a current through the replica transistor. In other words, the sense current (being the indication of the gate-to-source voltage at the pass transistor) may be derived from the current through the replica transistor. Due to the arrangement of the replica transistor, the replica transistor may be operated such that the replica transistor is submitted to the same gate-to-source voltage as the pass transistor. As a result of this, the current through the replica transistor provides a precise indication of the gate-to-source voltage.

The sensing means may further comprise an operational amplifier which is arranged to set a voltage at a drain of the replica transistor to be equal to the gate voltage at the gate of the pass transistor, thereby controlling the current through the replica transistor such that the current through the replica transistor provides a precise indication of the gate-to-source voltage of the drive transistor and therefore the gate-to-source voltage at the pass transistor.

Furthermore the sensing means may comprise a current mirror to derive the sense current from the current through the replica transistor.

Alternatively to using an operation amplifier, the sensing means may comprise a second monitor transistor which is configured to provide a second monitor current. The second monitor transistor may be a scaled version of the drive transistor. Furthermore, the second monitor transistor may be submitted to a gate-to-source voltage which is equal to the target voltage.

The sense current may then depend on the current through the replica transistor and on the second monitor current, notably on a difference between the current through the replica transistor and the second monitor current. In particular, the second monitor current may be generated such that it corresponds to twice the target current that corresponds to the target voltage of the gate-to-source voltage at the pass transistor. By consequence, the bypass regulation means ensure that the difference between the current through the replica transistor and the second monitor current is equal to the target current, in a situation when the gate-to-source voltage at the pass transistor is equal to the target voltage.

According to a further aspect, a method for providing at an output node of a regulator a load current at an output voltage is described. The regulator comprises a pass transistor for providing the load current at the output node from an input node. Furthermore, the regulator comprises a driver stage for setting a gate voltage at a gate of the pass transistor based on a drive current. The method comprises (selectively) setting the drive current in dependence of an indication of the output voltage at the output node and in dependence of a reference voltage for the output voltage. Furthermore, the method comprises (selectively) setting the drive current in dependence of an indication of the gate-to-source voltage at the pass transistor and in dependence of a target voltage for the gate-to-source voltage.

In the present document, the term "couple" or "coupled" refers to elements being in electrical communication with each other, whether directly connected e.g., via wires, or in some other manner.

BRIEF DESCRIPTION OF THE DRAWINGS

The invention is explained below in an exemplary manner with reference to the accompanying drawings, wherein.

DESCRIPTION

Figure 1A:
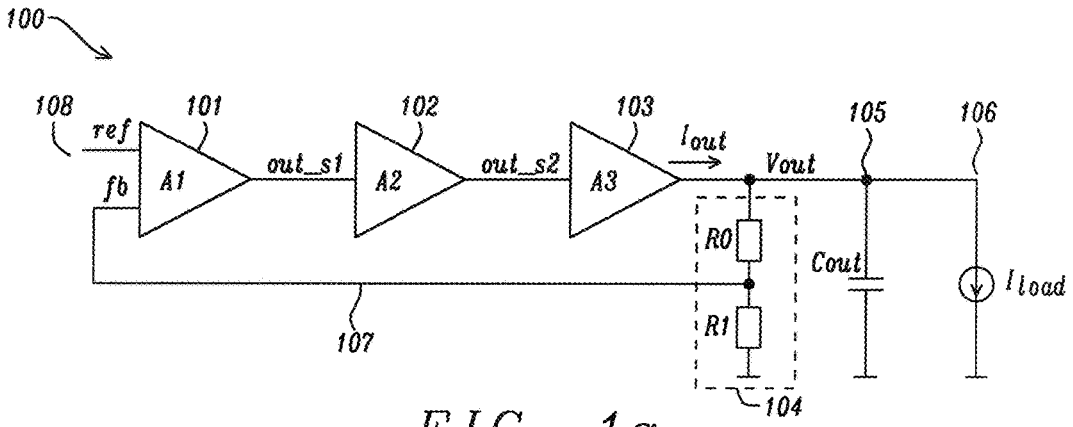
FIG. 1*a* illustrates an example block diagram of an LDO regulator.

As outlined above, the present document is directed at providing a voltage regulator with a stable and power-efficient bypass mode. An example of a voltage regulator is an LDO regulator. A typical LDO regulator 100 is illustrated in FIG. 1*a*. The LDO regulator 100 comprises an output amplification stage 103, comprising e.g. a field-effect transistor (FET), at the output and a differential amplification stage 101 (also referred to as error amplifier) at the input. A first input (fb) 107 of the differential amplification stage 101 receives a fraction of the output voltage $V_{out}$ determined by the voltage divider 104 comprising resistors R0 and R1. The second input (ref) to the differential amplification stage 101 is a stable voltage reference $V_{ref}$ 108 (also referred to as the bandgap reference). If the output voltage $V_{out}$ changes relative to the reference voltage $V_{ref}$, the drive voltage to the output amplification stage, e.g. to the power FET, changes by a feedback mechanism called main feedback loop to maintain a constant output voltage $V_{out}$.

The LDO regulator 100 of FIG. 1*a* further comprises an additional intermediate amplification stage 102 configured to amplify the output voltage of the differential amplification stage 101. An intermediate amplification stage 102 may be used to provide an additional gain within the amplification path. Furthermore, the intermediate amplification stage 102 may provide a phase inversion.

In addition, the LDO regulator 100 may comprise an output capacitance $C_{out}$ (also referred to as output capacitor or stabilization capacitor or bypass capacitor) 105 parallel to the load 106. The output capacitor 105 is used to stabilize the output voltage $V_{out}$ subject to a change of the load 106, in particular subject to a change of the requested load current $I_{load}$.

Figure 1B:
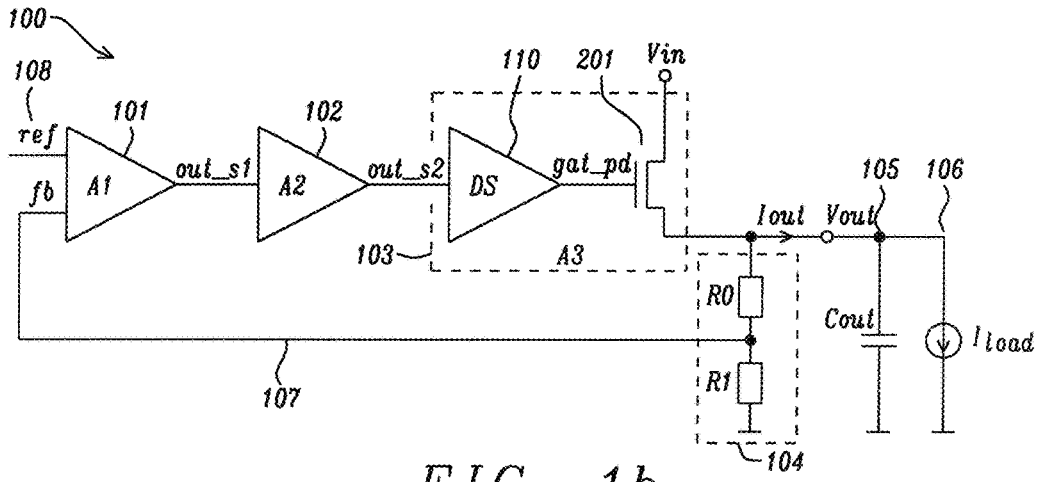
FIG. 1*b* illustrates the example block diagram of an LDO regulator in more detail.

FIG. 1*b* illustrates the block diagram of a LDO regulator 100, wherein the output amplification stage 103 is depicted in more detail. In particular, the pass transistor or pass device 201 and the driver stage 110 of the output amplification stage 103 are shown. Typical parameters of an LDO regulator 100 are a supply voltage of 5V (e.g from a battery supply), an output voltage of 0.5V, and an output current or load current ranging from 1 mA to 100 mA or 200 mA. Other configurations are possible.

Figure 2A:
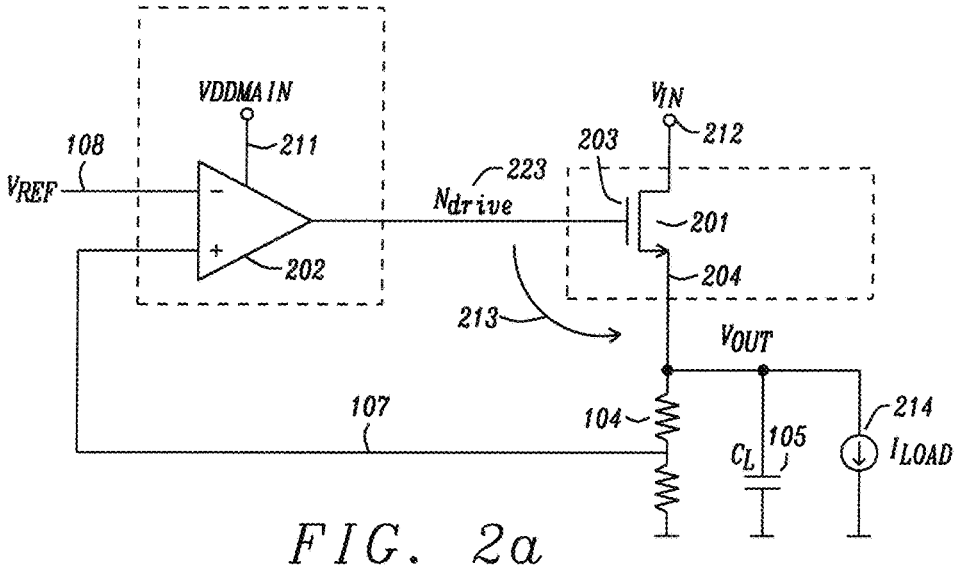
FIG. 2*a* shows a block diagram of a voltage regulator in a voltage regulation mode.

Modern power management integrated circuits (ICs) incorporate a variety of different low dropout regulators (LDOs) 100 to provide stable and accurately regulated supply rails. In order to fulfil area restrictions of an IC and in order to allow for power efficient designs, high current LDOs 100 are typically implemented with low voltage components (e.g. with a maximum input voltage Vin of up to 1.8V). For low input voltage LDOs 100 the pass transistor 201, which couples the input node and the output node of an LDO 100, may be implemented with a low voltage NMOS (N-type metal oxide semiconductor) transistor. FIG. 2*a* shows the typical schematic of a low voltage NMOS LDO 100. In particular FIG. 2*a* shows the input node 212 which is submitted to the input voltage $V_{in}$, the output node 204 for providing the output voltage $V_{out}$ and the load current 214, and the amplification stages 202 (comprising e.g. the units 101, 102, 110) for providing the drive voltage $N_{drive}$ for the gate 203 of the pass transistor 201.

As such, the typical LDO structure comprises two parts, the pass transistor 201 providing the load current 214 from the input node 212 to the output node 204 and the control block 202 for adjusting the gate-to-source voltage $V_{GS,\,Npass}$ 213 of the pass transistor 201 by regulating the drive voltage $N_{drive}$ at the gate 203 of the pass transistor 201 in dependence of the sensed output voltage $V_{out}$ (i.e. in dependence of the feedback voltage 107).

In order to allow for a low dropout voltage, i.e. in order to reduce or minimize the voltage difference between the input voltage $V_{in}$ and the output voltage $V_{on}$, for a given maximum current load, the gate-to-source voltage $V_{GS,\,Npass}$ 213 of the pass transistor 201 has to be higher than the input voltage $V_{in}$. By way of example, for an output voltage $V_{out}$=1.5V the drive voltage $N_{drive}$ may need to be as high as the desired output voltage $V_{out}$ plus the Vgs voltage $V_{gs,\,Npass}$ of the pass transistor (e.g. 1.0V), i.e. 2.5V. In order to deliver higher voltages to the gate 203 of the pass transistor 201 than the input voltage $V_{in}$, the control block 202 has to be supplied from a supply voltage VDDMAIN 211 which is higher than the input voltage $V_{in}$ (e.g. VDDMAIN e.g. <5V).

Besides the normal mode of operation, where the LDO 100 accurately regulates the output voltage $V_{out}$, a bypass mode may be required. During the bypass mode, the LDO 100 couples (i.e. bypasses) its input voltage $V_{in}$ directly to its output voltage $V_{out}$ with minimum possible resistance and without any regulation function regarding the output voltage $V_{out}$. An important requirement in such a bypass mode is the on-resistance of the pass transistor 201, the power dissipation in the pass transistor 201 and the area required by the pass transistor 201. In the bypass mode, the control block 202 has to provide a substantially constant gate-to-source voltage $V_{GS,\,Npass}$ 213 to the pass transistor 201. This may be a challenge as the output voltage $V_{out}$ is typically not constant and may vary depending on the load conditions and depending on the PVT (process, voltage, temperature) conditions of the pass transistor 201.

Figure 2B:
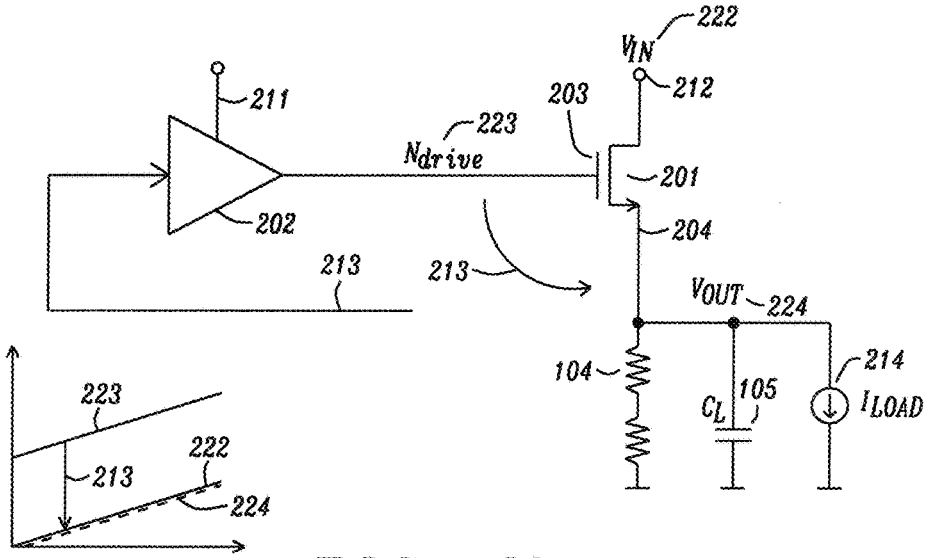
FIG. 2*b* shows a block diagram of a voltage regulator in a bypass mode.

FIG. 2*b* shows the requirements for the control block 202 in the bypass mode for a Low Voltage NMOS LDO 100. The control block 202 has to sense the gate-to-source voltage $V_{GS,\,Npass}$ 213 and regulate the gate-to-source voltage 213 to a fixed target voltage (e.g. 1.8V). As such, during the bypass mode, the control block 202 has to regulate the gate-to-source voltage 213 of the pass transistor 201 instead of regulating the output voltage $V_{out}$ of the pass transistor 201. FIG. 2*b* shows a varying output voltage 224 and a varying input voltage 222. The drive voltage 223 at the gate 203 of the pass transistor 201 should be regulated such that the gate-to-source voltage 213 of the pass transistor 201 remains constant for varying output voltages 224 and/or input voltages 222.

As such, the gate-to-source voltage 213 of the pass transistor 201 is to be maintained constant, independent of the load current $I_{LOAD}$ 214, the supply voltage VDDMAIN 211, the temperature and/or the input voltage $V_{in}$ 222. If the gate-to-source voltage 213 of the pass transistor 201 exceeds a predetermined target voltage (e.g. 1.8V), the gate oxide of the pass transistor 201 may break down. On the other hand, if the gate-to-source voltage 213 of the pass transistor 201 falls below the predetermined target voltage, the on-resistance of the pass transistor 201 in the bypass mode is increased (thereby increasing power losses of the system). Hence, a bypass mode with lowest possible on-resistance of the pass transistor 201 is to be provided for an LDO 100 utilizing a low voltage NMOS pass transistor 201, without damaging the pass transistor 201. Furthermore, the bypass mode should be based on the existing structure of an LDO 100.

In the following, load regulators 100 are described which comprise means for sensing the gate-to-source voltage 213 of a pass transistor 100 in a direct or indirect manner. In particular, a drive current $I_{drive}$ for driving the pass transistor 201 may be monitored as an indication of the gate-to-source voltage 213 of the pass transistor 201. The monitored drive current may be compared with a PVT condition-dependent monitor current to control the drive current $I_{drive}$ in the driver stage 110 of the LDO 100 and therefore maintain a constant gate-to-source voltage of the pass transistor 201 over PVT.

Figure 3:
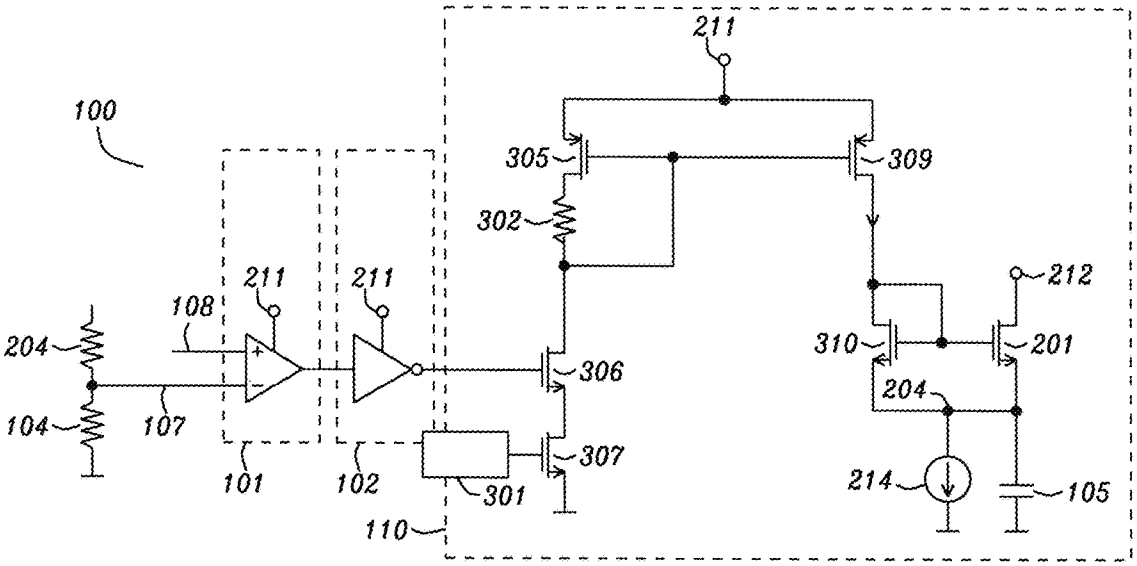
FIG. 3 shows further details regarding the driver stage of a voltage regulator.

FIG. 3 shows a block diagram of a low voltage NMOS LDO 100 with additional details regarding the driver stage 110. The drive transistor 310 of the driver stage 110 and the pass transistor 201 are typically low voltage transistors which cannot sustain gate-to-source voltages 213 that are higher than a pre-determined target voltage (of e.g. 1.8V). The supply voltage VDDMAIN 211 may be up to 5V. The LDO 100 of FIG. 3 comprises optional circuitry 301, 307 for limiting the current through the pass transistor 201.

The output of the intermediate amplification stage 102 may be used to control the current through a feedback control transistor 306, wherein the current through the feedback control transistor 306 is copied (and possibly amplified) using the current mirror 302, 305, 309, thereby providing the drive current $I_{drive}$ 321 (see FIG. 4*a*) through the drive transistor 310. The drive current $I_{drive}$ 321 impacts the gate-to-source voltage 213 at the drive transistor 310 and at the pass transistor 201.

Figure 4B:
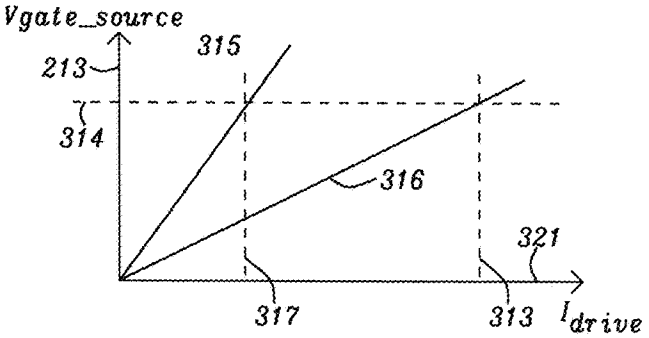
FIGS. 4*a* and 4*b* show example relationships between the drive current and the gate-to-source voltage at a drive transistor of a voltage regulator.
Figure 4A:
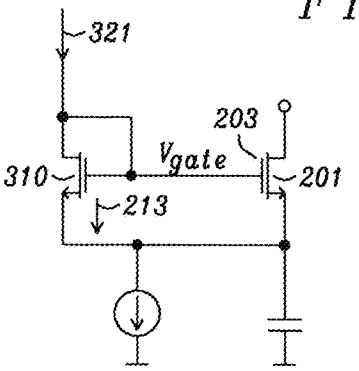

In the indirect sensing approach for sensing the gate-to-source voltage 213, the drive current $I_{drive}$ 321 flowing into the drive transistor (notably the drive diode) 310 is measured and the gate-to-source voltage 213 is predicted based on the drive current $I_{drive}$ 321 as shown in FIG. 4*b*. Also, FIG. 4*b* shows different reference relationships 315, 316 between the drive current 321 and the gate-to-source voltage 213. The reference relationships 315, 316 are dependent on the PVT conditions of the drive transistor 310. In particular, the target currents 317, 313 which correspond to a gate-to-source voltage 213 which is equal to the target voltage 314 depend on the PVT conditions of the drive transistor 310. As such, subject to tracking the PVT conditions of the drive transistor 310, the drive current 321 may be taken as a precise indication of the gate-to-source voltage 213.

Hence, a challenge of the indirect sensing approach is to predict the target current 313, 317 at which the drive diode 310 reaches a gate-to-source voltage 213 equal to the target voltage 314. By way of example, in a slow silicon implementation, the target current $I_1$ 317 is significantly lower as the target current $I_2$ 313 for a fast silicon implementation. In addition, the linear relationships 315, 316 are typically dependent on the operation temperature of the drive transistor 310.

Figure 5A:
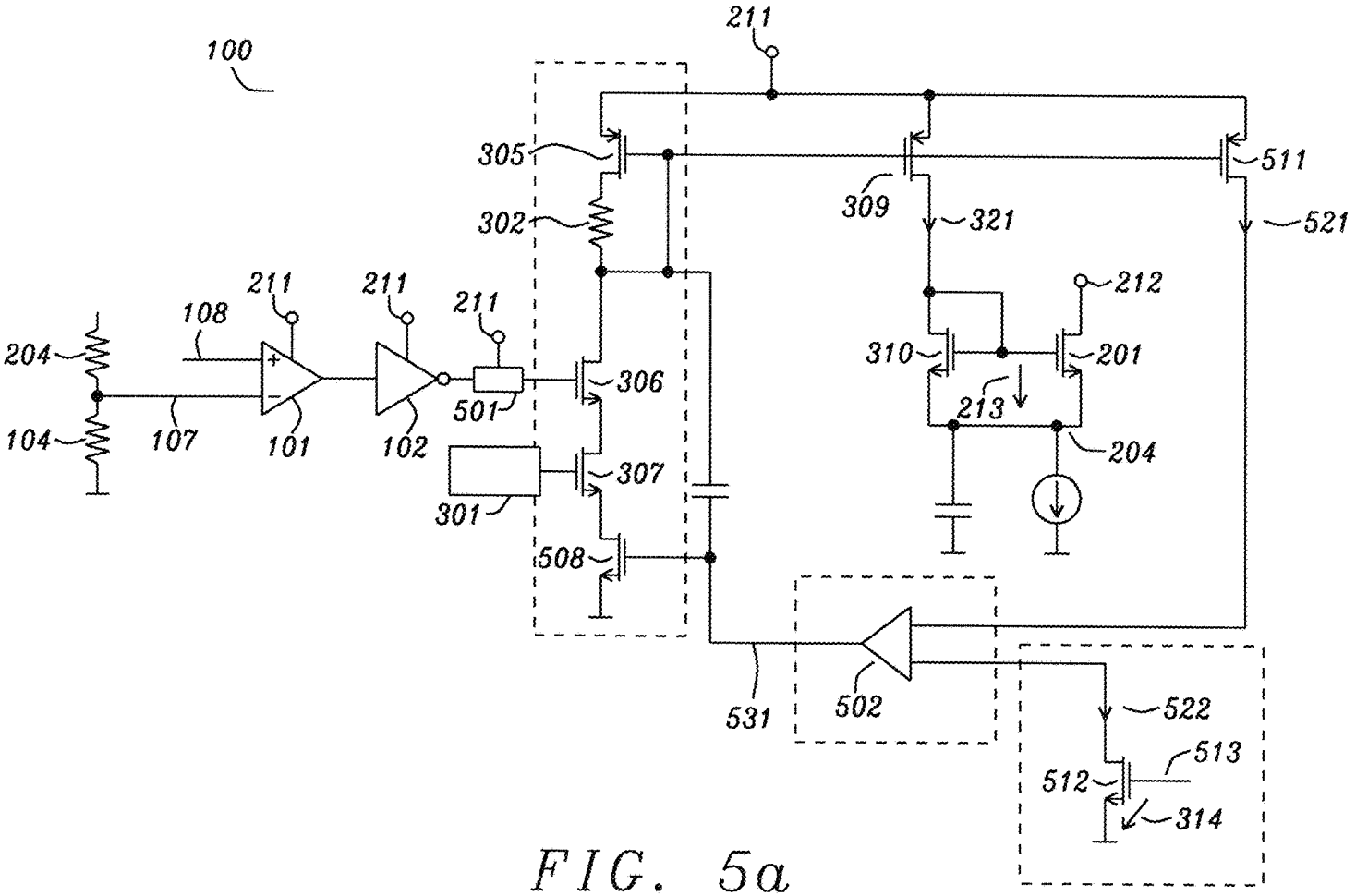
FIG. 5*a* shows a voltage regulator with example bypass regulation means using indirect sensing.

FIG. 5*a* shows a voltage regulator 100 comprising a monitor transistor 512 for generating a monitor current 522. The monitor transistor 512 is a (e.g. scaled) copy of the drive transistor 310. The gate 513 of the monitor transistor 512 is coupled to a fixed voltage level corresponding e.g. to the target voltage 314 for the gate-to-source voltage 213 of the pass transistor 201. In other words, the gate-to-source voltage at the monitor transistor 512 may correspond to the target voltage 314. As a result of this, the monitor current 522 corresponds to (a scaled version of) the drive current 313, 317 (i.e. the target current of FIG. 4*b*) through the drive transistor 310, at which the gate-to-source voltage 213 of the pass transistor 201 corresponds to the target value 314. In view of the fact that the monitor transistor 512 reflects the same PVT conditions as the drive transistor 310, the impact of the PVT conditions on the target current 313, 317 may be compensated.

The voltage regulator 100 of FIG. 5*a* further comprises a mirror transistor 511 (also referred to herein as the second mirror transistor) which forms a current mirror with the input transistor 305, such that the sense current 521 through the mirror transistor 511 corresponds to (a scaled version of) the drive current 321. The sense current 521 is compared to the monitor current 522 within the current comparator 502 to generate a bypass control signal 531 for regulating the drive current 321. In particular, the bypass control signal 531 may be used to control the current through the input transistor 305 using the bypass control transistor 508 which is arranged in series with the input transistor 305.

The regulator 100 may comprises a mode selection means 501 which may be used to switch between the voltage regulation mode and the bypass mode of the regulator 100. During the bypass mode, the mode selection means 501 may decouple the output of the intermediate amplification stage 102 from the driver stage 110 in FIG. 3. Furthermore, the gate of the feedback control transistor 306 may be coupled to the supply voltage 211.

As such, FIG. 5*a* shows a modified LDO 100 having a bypass mode. The LDO 100 comprises the monitor current generator 512 generating the monitor current 522 and a driver stage current replica device 511 generating a replica $I_{drive,\ rep}$ 521 of the drive current, which is proportional to the drive current $I_{drive}$ 321 in the driver stage 110. These currents are compared by the current comparator 502, which adjusts the current through the bypass control transistor 508. As the first and the second stage of the LDO 100 are disabled (by tying the feedback control transistor 306 to the supply voltage 211 using the mode selection means 501) only the optional current limit 301, 307 and the current comparator 502 define the gate-to-source voltage 213 by controlling the gates of the transistor 307 and the bypass control transistor 508, respectively.

By way of example, the monitor transistor 512 may be N times smaller than the drive transistor 310 (e.g. N=12). As a result of this, the monitor current 522 is N times smaller than the target current 313,317 in FIG. 4*b*, through the drive transistor 310 at which the gate-to-source voltage 213 of FIG. 4*a* corresponds to the target voltage 314 in FIG. 4*b*. In a similar manner, the second mirror transistor 511 may be designed such that the sense current 521 is N times smaller than the drive current 321.

Figure 5B:
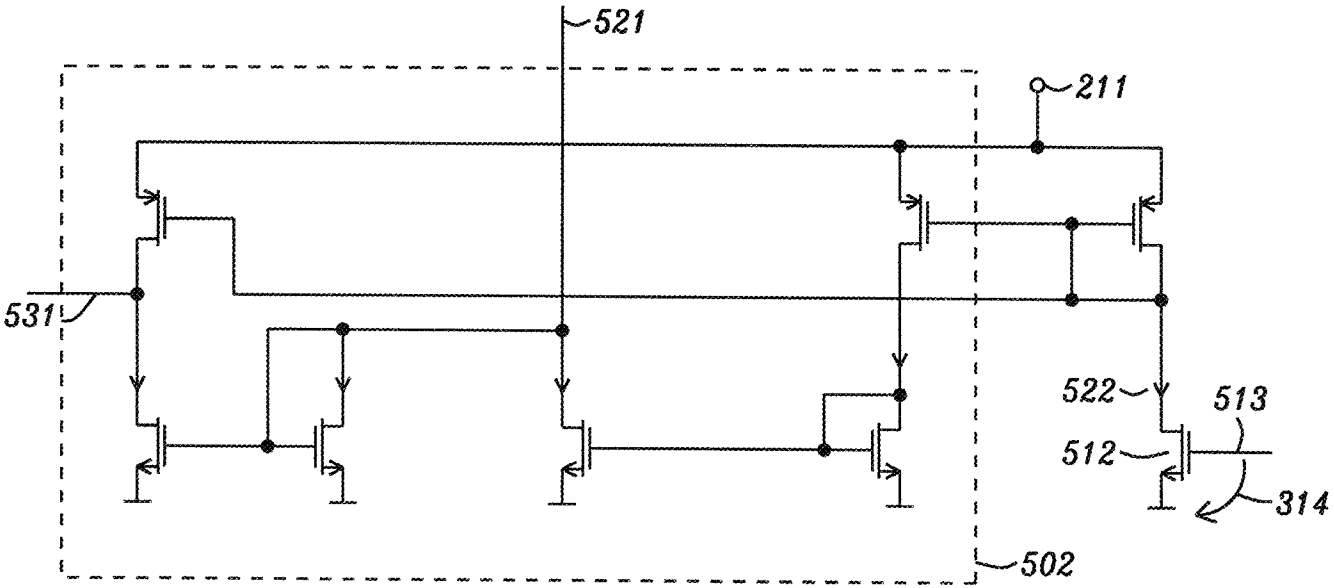
FIG. 5*b* shows a circuit diagram of an example current comparator.

FIG. 5*b* shows an example implementation of a current comparator 502.

Figure 6A:
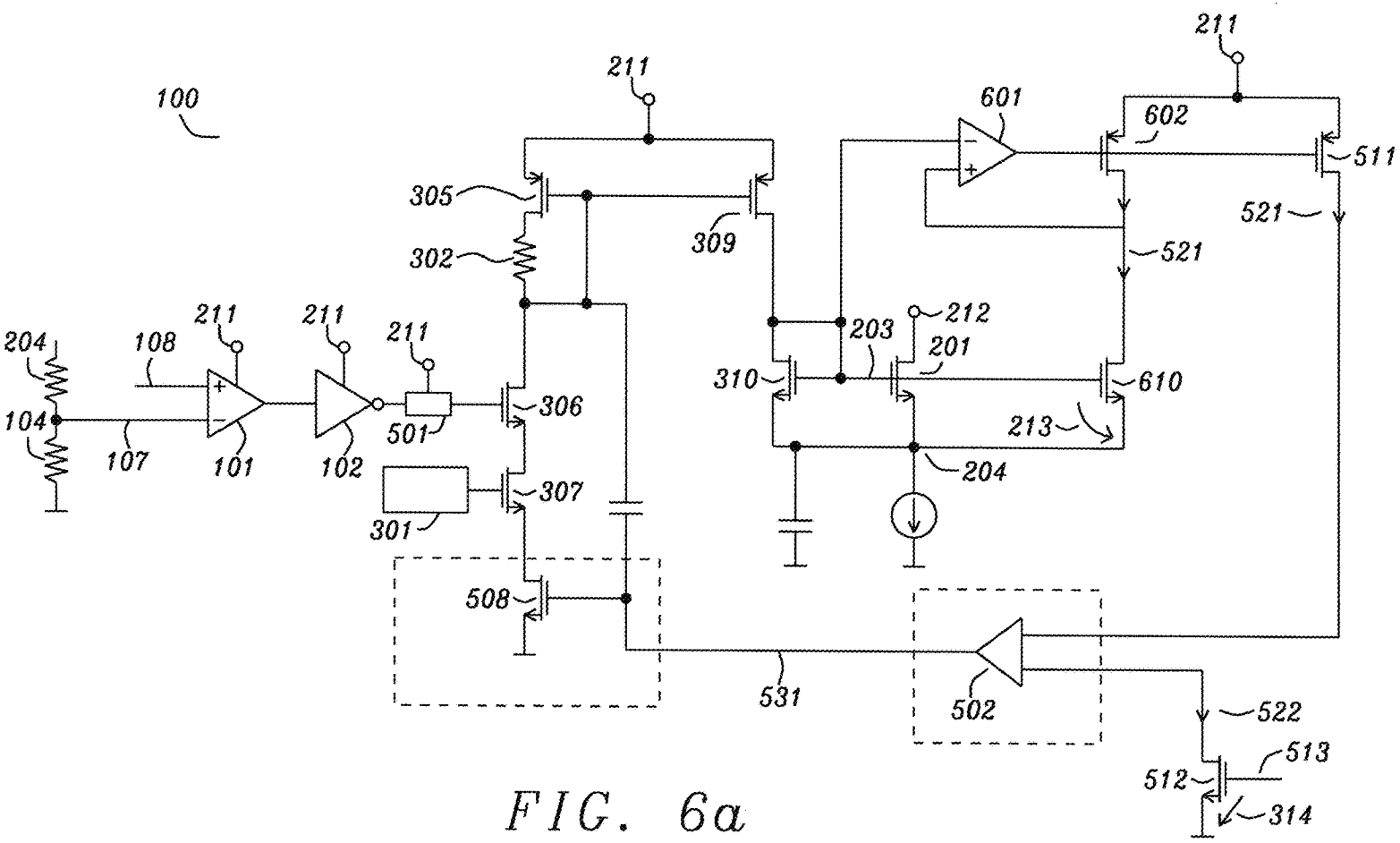
FIGS. 6*a* and 6*b* show voltage regulators with example bypass regulation means using direct sensing.

For a direct sensing approach, the gate-to-source voltage $V_{GS,\ Npass}$ 213 may be directly sensed by a replica transistor instead of predicting the gate-to-source voltage 213 from the drive current 321. FIG. 6*a* shows the direct sensing approach comprising a replica transistor 610 which is arranged to sense the gate-to-source voltage 213 directly, as the replica transistor 610 has the same gate and source connection as the pass transistor 201. The drain of the replica transistor 610 is regulated by an operational amplifier 601 and by the transistor 602 to the gate voltage 223 of the gate 203 of the pass transistor 201, in order to ensure that the replica transistor 610 is in saturation. The drain current $I_{replica}$ 521 through the replica transistor 610 is mirrored by transistors 602 and 611 to the current comparator 502, which may be implemented as shown in FIG. 5*b*.

Figure 6B:
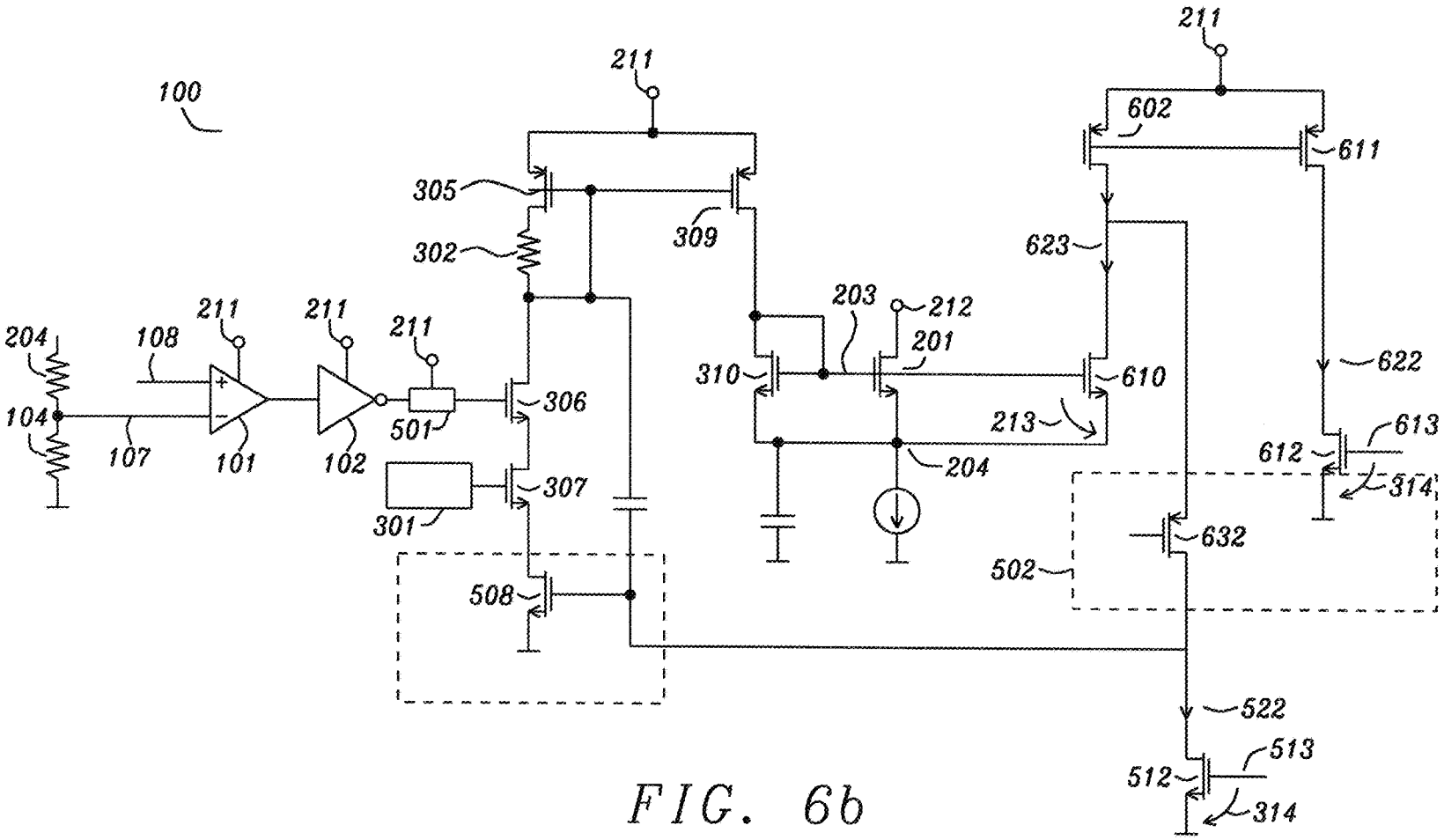

A further example of a direct sensing approach is illustrated in FIG. 6*b*. The regulator 100 comprises a second monitor transistor 612 to generate a second monitor current 622 that is mirrored to the drain of the sense transistor 610 using the transistors 611, 602, thereby providing the auxiliary current 623. The gate 613 of the second monitor transistor 612 is coupled to a voltage level corresponding to the target voltage 314. The auxiliary current 623 may be set to be twice the monitor current 522. As a result of this, a stable regulation condition may be achieved if the current through the replica transistor 610 corresponds to the monitor current 522 (which is equal to or proportional to the target current 313, 317 in FIG. 4*b*). The circuit arrangement of FIG. 6*b* allows for a simple implementation of the current comparator 502 (comprising the transistor 632, the gate of which is coupled to a fixed potential). Furthermore, the circuit arrangement of FIG. 6*b* does not require an operational amplifier.

Figure 7:
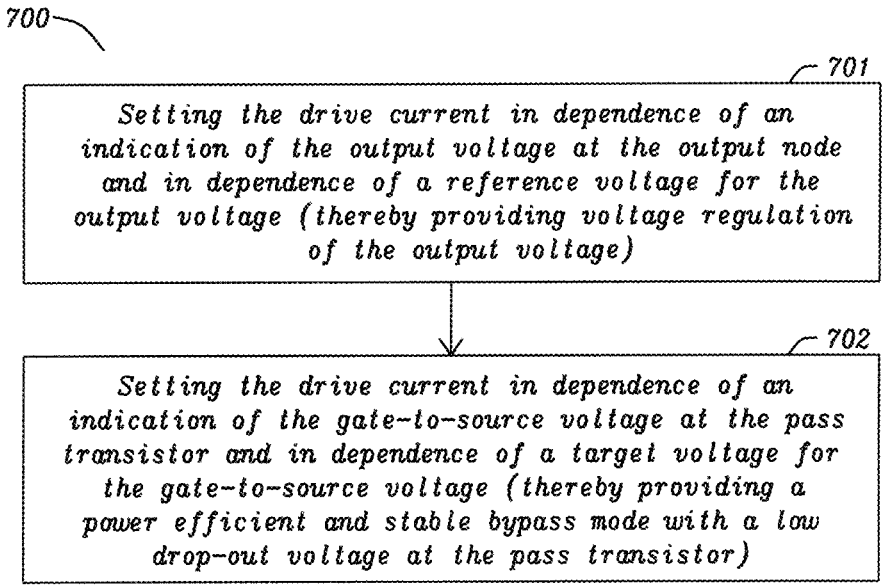
FIG. 7 shows a flow chart of an example method for providing a load current at an output node of a regulator.

FIG. 7 shows a flow chart of an example method 700 for providing at an output node 204 of a regulator 100 a load current 214 at an output voltage 224 as in FIG. 2*b*. The regulator 100 comprises a pass transistor 201 for providing the load current 214 at the output node 204 from an input node 212 of the regulator 100. Furthermore, in the FIG. 4*a*, the regulator 100 comprises a driver stage 310 for setting a gate voltage 223 at a gate 203 of the pass transistor 201 based on a drive current 321.

The method 700 comprises setting 701 the drive current 321 in dependence of an indication of the output voltage 224 at the output node 204 and in dependence of a reference voltage 108 for the output voltage 224 (thereby providing voltage regulation of the output voltage 224). Alternatively or in addition, the method 700 comprises setting 702 the drive current 321 in dependence of an indication of the gate-to-source voltage 213 at the pass transistor 201 and in dependence of a target voltage 314 for the gate-to-source voltage 213 (thereby providing a power efficient and stable bypass mode with a low drop-out voltage at the pass transistor 201).

As such, voltage regulators 100 have been described which provide a stable and power-efficient bypass mode. In particular, the described voltage regulators 100 comprise means for setting the gate-to-source voltage of the pass transistor 201 of the voltage regulators 100 to a fixed target voltage 314 to enable a stable and power-efficient bypass mode for varying load conditions.

It should be noted that the description and drawings merely illustrate the principles of the proposed methods and systems. Those skilled in the art will be able to implement various arrangements that, although not explicitly described or shown herein, embody the principles of the invention and are included within its spirit and scope.

Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A voltage regulator configured to provide at an output node a load current at an output voltage, wherein the voltage regulator comprises, a pass transistor for providing the load current at the output node from an input node;

a driver stage configured to set a gate voltage at a gate of the pass transistor based on a drive current;

voltage regulation means configured to set the drive current in dependence of an indication of the output voltage at the output node and in dependence of a reference voltage for the output voltage;

bypass regulation means configured to set the drive current in dependence of an indication of a gate-to-source voltage at the pass transistor and in dependence of a target voltage for the gate-to-source voltage; and mode selection means configured to activate the voltage regulation means and/or the bypass regulation means.

2. The voltage regulator of claim 1, wherein the bypass regulation means comprise sensing means configured to provide a sense current as the indication of the gate-to-source voltage at the pass transistor;

monitoring means configured to provide a monitor current which is dependent on the target voltage;

a current comparator configured to determine a bypass control signal by comparing the sense current and the monitor current; and bypass driver means configured to set the drive current in dependence of the bypass control signal.

3. The voltage regulator of claim 2, wherein the monitoring means are configured to provide the monitor current in dependence of a process parameter and/or in dependence of an operation temperature of the driver stage.

4. The voltage regulator of claim 2, wherein the driver stage comprises a drive transistor having a gate that is coupled to the gate of the pass transistor, having a source that is coupled to a source of the pass transistor, and having a drain that is coupled to the gate of the drive transistor; and the monitoring means comprise a monitor transistor which is a scaled copy of the drive transistor.

5. The voltage regulator of claim 4, wherein a gate-to-source voltage at the monitor transistor corresponds to the target voltage.

6. The voltage regulator of claim 2, wherein the bypass driver means comprises a bypass control transistor which is controlled by the bypass control signal;

the driver stage comprises an input transistor which is coupled in series with the bypass control transistor, such that a current through the bypass control transistor corresponds to a current through the input transistor; and the driver stage comprises a first mirror transistor forming a current mirror with the input transistor and providing the drive current wherein the voltage regulation means comprise feedback means for deriving a feedback voltage from the output voltage at the output node; and a differential amplifier configured to control a current through a feedback control transistor in dependence of the feedback voltage and in dependence of the reference voltage; wherein the drive current depends on the current through the feedback control transistor.

7. The voltage regulator of claim 6, wherein the sensing means comprise a second mirror transistor forming a second current mirror with the input transistor and providing the sense current.

8. The voltage regulator of claim 6, wherein the feedback control transistor is arranged in series with the input transistor and the bypass control transistor; and the mode selection means are configured to deactivate the voltage regulation means by decoupling a gate of the feedback control transistor from an output of the differential amplifier; and/or activate the bypass regulation means by coupling the gate of the feedback control transistor to a supply voltage.

9. The voltage regulator of claim 6, wherein the sensing means comprise a replica transistor having a gate that is coupled to the gate of the pass transistor and having a source that is coupled to a source of the pass transistor; and the sense current is dependent on a current through the replica transistor .

10. The voltage regulator of claim 9, wherein the sensing means comprise an operational amplifier arranged to set a voltage at a drain of the replica transistor equal to the gate voltage at the gate of the pass transistor, thereby controlling the current through the replica transistor.

11. The voltage regulator of claim 9, wherein the sensing means comprise a current mirror to derive the sense current from the current through the replica transistor.

12. The voltage regulator of claim 9, wherein the sensing means comprise a second monitor transistor configured to provide a second monitor current; and the sense current depends on the current through the replica transistor and on the second monitor current, notably on a difference between the current through the replica transistor and the second monitor current.

13. The voltage regulator of claim 2, wherein the current comparator is configured to increase or decrease the bypass control signal, depending on whether the sense current is greater or smaller than the monitor current.

14. The voltage regulator of claim 1, wherein the voltage regulation means comprise feedback means for deriving a feedback voltage from the output voltage at the output node; and a differential amplifier configured to control a current through a feedback control transistor in dependence of the feedback voltage and in dependence of the reference voltage; wherein the drive current depends on the current through the feedback control transistor.

15. A method of providing a voltage regulator to provide, at an output node, a load current and an output voltage, comprising the steps of:

providing the load current at the output node from an input node with a pass transistor;

setting a gate voltage at a gate of the pass transistor based on a drive current with a driver stage;

setting the drive current in dependence of an indication of the output voltage at the output node and in dependence of a reference voltage for the output voltage with a voltage regulation means;

setting the drive current in dependence of an indication of the gate-to-source voltage at the pass transistor and in dependence of a target voltage for the gate-to-source voltage with a bypass regulation means; and activating the voltage regulation means and/or the bypass regulation means by mode selection means, wherein the bypass regulation means further comprises the steps of:

providing a sense current as the indication of the gate-to-source voltage at the pass transistor by sensing means;

providing a monitor current which is dependent on the target voltage by monitoring means;

determining a bypass control signal by comparing the sense current and the monitor current by a current comparator; and setting the drive current in dependence of the bypass control signal by bypass driver means.

16. The method of providing a voltage regulator of claim 15, comprising the step of: providing the monitor current in dependence of a process parameter and/or in dependence of an operation temperature of the driver stage by the monitoring means.

17. The method of providing a voltage regulator of claim 15, wherein the driver stage comprises a drive transistor having a gate that is coupled to the gate of the pass transistor, having a source that is coupled to a source of the pass transistor, and having a drain that is coupled to the gate of the drive transistor; and the monitoring means comprise a monitor transistor which is a scaled copy of the drive transistor.

18. The method of providing a voltage regulator of claim 17, wherein a gate-to-source voltage at the monitor transistor corresponds to the target voltage.

19. The method of providing a voltage regulator of claim 15, wherein the bypass driver means comprises a bypass control transistor which is controlled by the bypass control signal;

the driver stage comprises an input transistor which is coupled in series with the bypass control transistor, such that a current through the bypass control transistor corresponds to a current through the input transistor; and the driver stage comprises a first mirror transistor forming a current mirror with the input transistor and providing the drive current;

wherein the voltage regulation means comprise feedback means for deriving a feedback voltage from the output voltage at the output node; and a differential amplifier to control a current through a feedback control transistor in dependence of the feedback voltage and in dependence of the reference voltage;

wherein the drive current depends on the current through the feedback control transistor.

20. The method of providing a voltage regulator of claim 19, wherein the sensing means comprise a second mirror transistor forming a second current mirror with the input transistor and providing the sense current.

21. The method of providing a voltage regulator of claim 19, wherein the feedback control transistor is arranged in series with the input transistor and the bypass control transistor; and the mode selection means are used to deactivate the voltage regulation means by decoupling a gate of the feedback control transistor from an output of the differential amplifier; and/or activate the bypass regulation means by coupling the gate of the feedback control transistor to a supply voltage.

22. The method of providing a voltage regulator of claim 19, wherein the sensing means comprise a replica transistor having a gate that is coupled to the gate of the pass transistor and having a source that is coupled to a source of the pass transistor; and the sense current is dependent on a current through the replica transistor.

23. The method of providing a voltage regulator of claim 22, wherein the sensing means comprise an operational amplifier arranged to set a voltage at a drain of the replica transistor equal to the gate voltage at the gate of the pass transistor, thereby controlling the current through the replica transistor.

24. The method of providing a voltage regulator of claim 22, wherein the sensing means comprise a current mirror to derive the sense current from the current through the replica transistor.

25. The method of providing a voltage regulator of claim 22, wherein the sensing means comprise a second monitor transistor to provide a second monitor current; and the sense current depends on the current through the replica transistor and on the second monitor current, notably on a difference between the current through the replica transistor and the second monitor current.

26. The method of providing a voltage regulator of claim 15, wherein the current comparator increases or decreases the bypass control signal, depending on whether the sense current is greater or smaller than the monitor current.

27. The method of providing a voltage regulator of claim 15, wherein the voltage regulation means comprise feedback means for deriving a feedback voltage from the output voltage at the output node; and a differential amplifier to control a current through a feedback control transistor in dependence of the feedback voltage and in dependence of the reference voltage; wherein the drive current depends on the current through the feedback control transistor.

* * * * *